US008230653B2

(12) United States Patent
Hoshi

(10) Patent No.: US 8,230,653 B2
(45) Date of Patent: Jul. 31, 2012

(54) FLOOR SLAB PENETRATION STRUCTURE AND FLOOR SLAB PENETRATION HOLE REPAIR METHOD

(75) Inventor: Isao Hoshi, Hiratsuka (JP)

(73) Assignee: Toshiba Plant Systems & Services Corporation, Yokohama-shi (JP)

( * ) Notice: Subject to any disclaimer, the term of this patent is extended or adjusted under 35 U.S.C. 154(b) by 0 days.

(21) Appl. No.: 12/934,768

(22) PCT Filed: Mar. 23, 2009

(86) PCT No.: PCT/JP2009/055685

§ 371 (c)(1),
(2), (4) Date: Sep. 27, 2010

(87) PCT Pub. No.: WO2009/119516

PCT Pub. Date: Oct. 1, 2009

(65) Prior Publication Data

US 2011/0023395 A1 Feb. 3, 2011

(30) Foreign Application Priority Data

Mar. 26, 2008 (JP) ..... 2008-081161

(51) Int. Cl.
*E04H 12/00* (2006.01)
*E04B 1/70* (2006.01)
*E04F 17/00* (2006.01)

(52) U.S. Cl. ..... 52/302.1; 52/310

(58) Field of Classification Search ..... 52/302.1, 52/310, 576, 414, 302.2, 220.8, 125.1; 285/42; 4/679, 695, 507, 650
See application file for complete search history.

(56) References Cited

U.S. PATENT DOCUMENTS

| | | | | |
|---|---|---|---|---|
| 5,035,097 | A * | 7/1991 | Cornwall | 52/220.8 |
| 5,309,688 | A * | 5/1994 | Robertson | 52/220.8 |
| 6,088,972 | A * | 7/2000 | Johanneck | 52/100 |
| 2008/0313993 | A1 * | 12/2008 | Reen | 52/718.01 |
| 2011/0023395 | A1 * | 2/2011 | Hoshi | 52/302.1 |

FOREIGN PATENT DOCUMENTS

JP 6 85860 12/1994

OTHER PUBLICATIONS

International Preliminary Report on Patentability issued Nov. 25, 2010 in International Application No. PCT/JP2009/055685.
International Search Report issued May 25, 2009 in PCT/JP2009/55685 filed Mar. 23, 2009.

* cited by examiner

*Primary Examiner* — Brian Glessner
*Assistant Examiner* — Paola Agudelo
(74) *Attorney, Agent, or Firm* — Oblon, Spivak, McClelland, Maier & Neustadt, L.L.P.

(57) ABSTRACT

As a temporary drainage equipment, a penetration hole is formed to a floor slab of a building under construction, the penetration hole is provided with a substantially cylindrical funnel portion opened to a floor surface of a room, a connection pipe is communicated to a bottom portion of the funnel portion, and a hose guide pipe is inserted to the lower end portion of the connection pipe. An inner flange portion is provided to the lower end portion of the hose guide pipe so as to be flush with a ceiling surface of the downfloor room.

6 Claims, 6 Drawing Sheets

FLOOR SLAB PENETRATION STRUCTURE AND FLOOR SLAB PENETRATION HOLE REPAIR METHOD

TECHNICAL FIELD

The present invention concerns a temporary drainage technology for draining outside rain water that flows into a building under construction such as a reactor building of a nuclear power plant, and more specifically, relates to a floor slab penetration structure provided to the building under construction and also relates to a method of repairing a penetration hole.

BACKGROUND ART

When a concrete multiple-story (or multiple-floor) building such as a high-rise building and a reactor building is constructed, the building is constructed by casting concrete sequentially from a lowest floor. For example, casting working of concrete in a second floor portion is started after casting working of concrete in a first floor portion has been completed by constructing a slab in a ceiling portion of the first floor (a floor portion of the second floor).

It is not preferable that rain water or the like flows into a lower floor that has already been constructed during construction or another work of a floor above the lower floor that has already been constructed. Particularly, to improve construction efficiency, interior finish work or installation of a reactor or equipment may be started in the floor that has already been constructed. In such case, it is strictly essential to prevent the rain water from flowing into the floor.

Generally, one of floors that have already been constructed is employed as a water stop floor to prevent rain water from flowing into downstairs' floors of the water stop floor. The rain water stored on a floor slab of the water stop floor is drained by a pump or the like.

FIG. 6 is a schematic configuration diagram illustrating a conventional drainage system.

As shown in FIG. 6, a conventional temporary drainage system 70 is provided in a reinforced concrete or steel-reinforced concrete multiple-story building 1 under construction. In the multiple-story building 1, a first floor 72 and a second floor 73 have been constructed, and a third floor 74 is being constructed. For example, the second floor 73 is employed as the water stop floor. Rain water flowing from the third floor 74 and floors above the third floor 74 is stopped on a floor slab 75 of the second floor 73 (a ceiling slab of the first floor), to prevent rain water from flowing into the first floor.

Accordingly, the rain water flowing from the upper floors is stopped at the water stop floor, and does not flow into the first floor 72. The rain water stored on the floor slab 75 is discharged by a pump 76 to the outside of the building from an opening 79 for a window formed in a side wall 78 of the second floor 73 through a hose 77 (for example, see Patent Document 1: Japanese Patent Laid-Open No. 2004-84414).

The concrete multiple-story building such as a reactor building has a plurality of rooms on one floor. In the concrete multiple-story building described above, when an upper floor under construction is employed as the water stop floor, drainage water such as rain water is stored in the plurality of rooms, and under the condition, in order to drain drainage from the building having a plurality of floors, a plurality of pumps are required. Thus, it is difficult to effectively discharge the drainage water to the outside from the multiple-story building.

Then, there has been proposed a technology in which drainage is discharged from the building having a plurality of floors by moving the drainage from an upper floor to a lower floor subsequently through a penetration (through) hole to a floor slab. In such technology, it is necessary to plug or bury the penetration hole to be closed after the completion of the construction of the building.

However, there are some buildings each of which has a high ceiling, a vaulted ceiling structure through several floors or like, in a case when it is required to repair and bury the penetration hole formed to a floor slab of a certain floor, there is caused a difficult working to approach a ceiling of a floor on a back side of a floor slab of the certain floor. In such a case, there may cause a case that repairing working of the penetration hole and cure after the repairing working are not sufficiently performed.

DISCLOSURE OF THE INVENTION

An object of the present invention is to provide a floor slab penetration structure and a method of repairing the floor slab penetration hole capable of effectively discharging drainage water over long periods and easily performing a repairing working with a simple structure in a concrete multiple-story building under construction.

To achieve the above object, the present invention provides a floor slab penetration structure, comprising:

a penetration hole formed to a floor slab of a building so as to penetrate the floor slab, the penetration hole being provided with a funnel portion, which has substantially a cylindrical shape and opened to a floor slab surface of the building;

a connection pipe communicated with a bottom portion of the funnel portion of the penetration hole;

a hose guide pipe inserted into a lower end of the connection pipe so as to be communicated therewith; and an inner flange portion formed to be substantially flush with a lower surface of the floor slab abutting against a lower end of the hose guide pipe so as to extend inward.

In a preferred embodiment of the floor slab penetration structure mentioned above, it may be desired that the connection pipe communicated with the bottom portion of the funnel portion of the penetration hole has an inserted upper end positioned below an upper surface of the floor slab of the building.

It may be desired that the inner flange portion is formed of stainless steel.

Furthermore, the present invention is characterized by providing a method of repairing a penetration hole of a floor slab penetration structure provided with: a penetration hole formed to a floor slab of a building so as to penetrate the floor slab, the penetration hole being provided with a funnel portion, which has substantially a cylindrical shape and opened to a floor slab surface of the building; a connection pipe communicated with a bottom portion of the funnel portion of the penetration hole; a hose guide pipe inserted into a lower end of the connection pipe so as to be communicated therewith; and an inner flange portion formed to be substantially flush with a lower surface of the floor slab abutting against a lower end of the hose guide pipe so as to extend inward, the repairing method comprising the steps of:

preparing a penetration hole closing member to be inserted into the penetration hole to close the penetration hole;

inserting the penetration hole closing member into the connection pipe disposed in to the penetration hole so as to abut against the inner flange portion to thereby close the penetration hole; and pouring a repairing material into the floor slab penetration hole from the funnel portion thereof.

It may be desired that the repairing material is a mortar.

It may be desired that the penetration hole closing member is provided with a closing plate made of stainless steel abutting against the inner flange portion so as to close the penetration hole.

The present invention having the aforementioned features can provide the floor slab penetration structure and the method of repairing the floor slab penetration hole in a temporary drainage system capable of effectively discharging drainage water over long periods with a simple configuration in a concrete multiple-story building under construction.

BEST MODE FOR CARRYING OUT THE INVENTION

In the following, an embodiment of a temporary drainage system according to the present invention will be described with reference to FIGS. 1 to 5.

Figure 1:
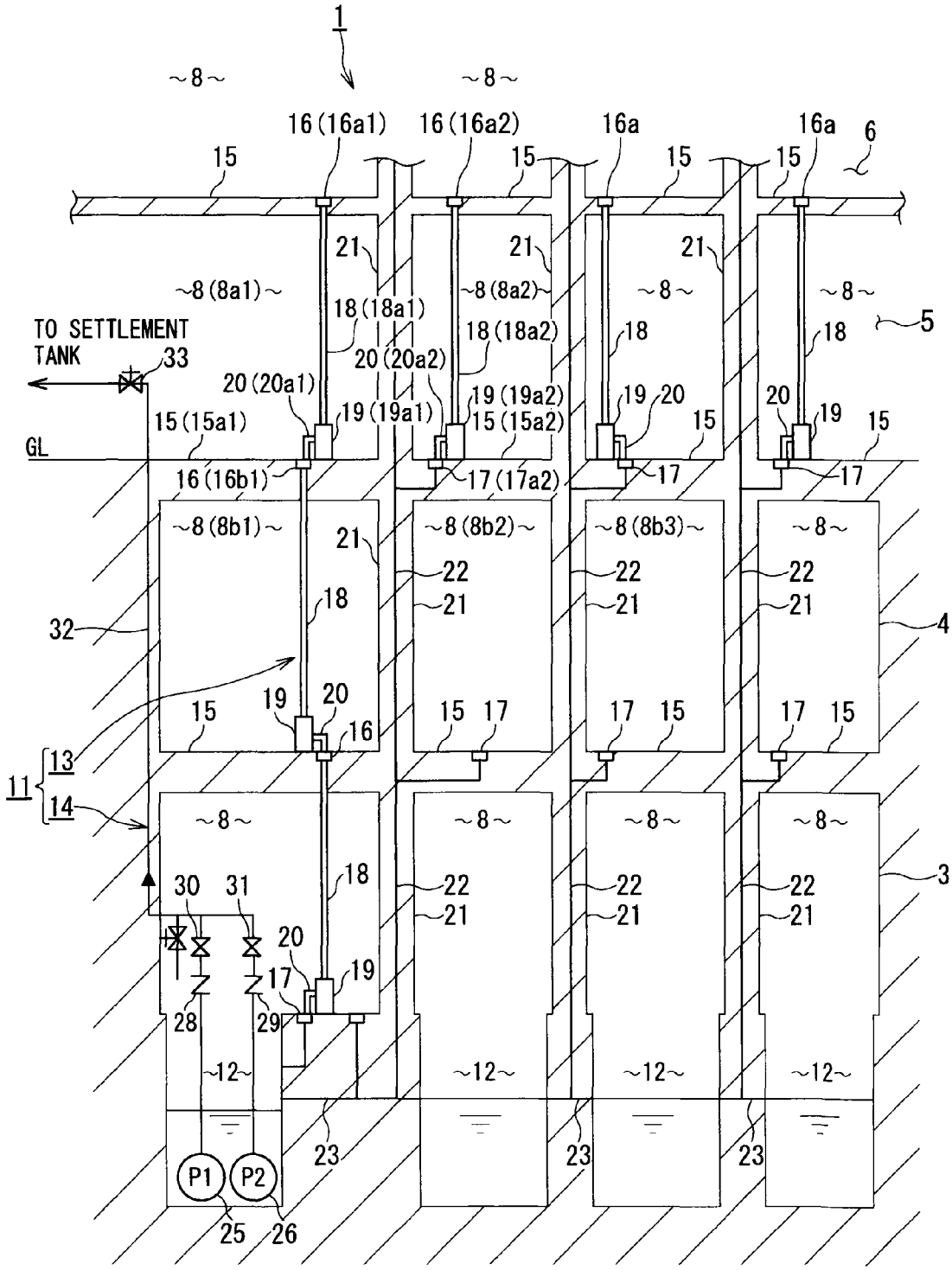
FIG. 1 is a schematic view of a multiple-story building under construction to which a temporary drainage system according to the present invention is applied.

FIG. 1 shows a building under construction, in which a multiple-story building 1 is a reinforced concrete reactor building, which is of substantially square shape having about 100 m on each side in a plan view of the multiple-story building 1 in the present embodiment.

In the multiple-story building 1 shown in FIG. 1, a second basement floor 3, a first basement floor 4, and a first floor 5 have been already constructed, and a second floor 6 is under construction.

A plurality of rooms 8 are provided on each of the floors of the multiple-story building 1 under construction, and for example, the total number of rooms 8 is about 500 in a case where the multiple-story building 1 is the reactor building. The rooms 8 include an electrical room in which electrical equipment is housed (for example, the rooms 8 (8*b*2) and 8 (8*b*3) on the first basement floor in FIG. 1).

A temporary drainage system 11 is provided in the multiple-story building 1.

The temporary drainage system 11 includes a drainage collection unit 13 for collecting drainage water within the multiple-story building 1 into a drainage pit 12, and a drainage discharge unit 14 for discharging the drainage water collected into the drainage pit 12 to the outside of the multiple-story building 1. The drainage pit 12 is provided on a lowest floor of the multiple-story building 1.

The drainage collection unit 13 includes a drainage penetration structure having a floor slab penetration hole 16 in a floor slab 15 of each of the rooms 8 in accordance with characteristics of respective rooms 8 and also includes a drainage funnel structure provided with a drainage collection funnel structure.

The floor slab penetration hole 16 is provided so as to communicate the room 8 on a given floor with the room 8 on the floor below the given floor. One end of a flexible collection hose 18 is removably connected to the floor slab penetration hole 16. The other end of the collection hose 18 is connected to a sand-settling vessel 19. The sand-settling vessel 19 is provided on the floor slab 15 of the floor below. Drainage water supplied from the floor above is temporarily stored in the sand-settling vessel 19.

The sand-settling vessel 19 can store a substance such as sand and dirt having a higher specific gravity than water contained in the drainage water and discharge drainage water mainly containing liquid. The drainage water discharged from the sand-settling vessel 19 is discharged to the floor below through the floor slab penetration hole 16 provided in the floor slab 15 from a discharge hose 20. The discharge hose 20 is connected to the sand-settling vessel 19. The drainage water is sequentially conveyed to the lower floors in a repeated manner to finally reach the drainage pit 12.

The above configuration will be more specifically described hereunder with reference to FIG. 1.

The floor slab penetration structure in the drainage collection unit 13 includes the penetration hole 16 (16*a*1) formed in the floor slab 15 to bring a room on the second floor 6 under construction and the room 8 (8*a*1) on the constructed first floor 5 into communication with each other, for example. The collection hose 18 (18*a*1) connected to the floor slab penetration hole 16 (16*a*1) is connected to the sand-settling vessel 19 (19*a*1) provided on the floor slab 15 (15*a*1) of the room 8 (8*a*1) on the first floor 5. The discharge hose 20 (20*a*1) of the sand-settling vessel 19 (19*a*1) is connected to the floor slab penetration hole 16 (16*b*1) provided in the floor slab 15 (15*a*1). The drainage water is repeatedly conveyed to the lower floors to reach the drainage pit 12.

In the present invention, the drainage collection funnel structure may be employed instead of the above penetration hole structure depending on the type of the building. For example, in a case where a building includes a room in which it is strictly required to prevent, such as a room in which electrical equipment or the like is provided, even in the temporary system.

For example, the drainage collection funnel structure having the drainage collection funnel 17 (17*a*2) is provided in the ceiling floor slab 15 (15*a*2) of the room 8 (8*b*2) with electrical equipment or the like formed on the first basement floor 4 of the building in FIG. 1. The drainage collection funnel 17 (17*a*2) is connected to a drainage collection riser pipe 22. The drainage collection riser pipe 22 is buried in the floor slab 15 (15*a*2) and a side wall 21 of the room 8 (8*b*2). The drainage collection riser pipe 22 is connected to a pit communicating pipe 23 in the side wall of the lowest floor.

The drainage pit 12 is provided in almost four corners of the second basement floor 3 as the lowest floor. The drainage pits 12 are provided such that a maximum water level of the stored water is lower than a floor position of the second basement floor 3 as the lowest floor. The drainage pits 12 communicate with each other through the pit communicating pipe 23, so that the water storage amount in each of the drainage pits 12 is maintained at substantially the same level as each other.

A first drainage pump 25 with small output and a second drainage pump 26 with large output are provided in the drainage pit 12 as the drainage discharge unit 14. The first drainage pump 25 and the second drainage pump 26 are connected to a drainage discharge pipe 32 via check valves 28 and 29, and gate valves 30 and 31, respectively. The drainage discharge pipe 32 is connected to a settlement tank via a gate valve 33.

Although the first drainage pump 25 and the second drainage pump 26 are provided in the present embodiment, only one of the drainage pumps may be employed.

Figure 2:
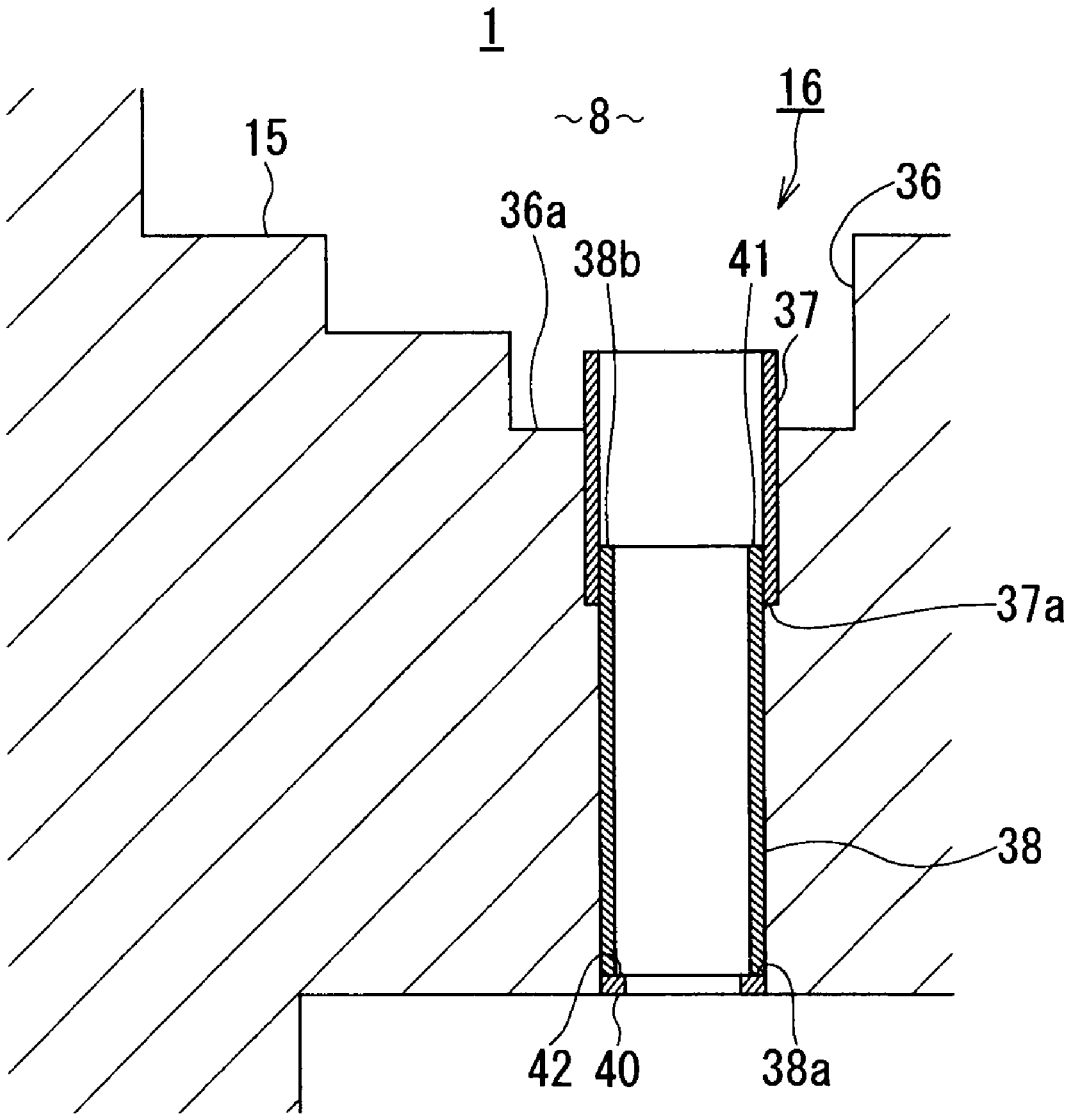
FIG. 2 is a partial sectional view of the multiple-story building illustrating a structure of a hole penetrating a floor slab (called floor slab penetration hole structure, hereinlater) of the temporary drainage system according to the present invention.

FIG. 2 is a partial sectional view of the multiple-story building illustrating the floor slab penetration structure of the temporary drainage system according to the present invention.

As shown in FIG. 2, the floor slab penetration hole 16 is formed in the floor slab 15 of the multiple-story building 1 under construction.

The floor slab penetration hole 16 is formed so as to penetrate the floor slab 15 at the same time of casting concrete to form the floor slab 15.

The floor slab penetration hole 16 includes a substantially cylindrical funnel portion 36 that opens in a floor surface of the room 8. A connection pipe portion 37 is inserted from a bottom portion of the funnel portion 36, and a hose guide pipe portion 38 is inserted into a lower end of the connection pipe portion 37 to communicate therewith. An inner flange portion 40 extending inward is provided substantially flush with a ceiling surface of the lower floor in a lower end portion 38*a* of the hose guide pipe portion 38.

One end (an upper end in the illustration) of the connection pipe portion 37 projects upward from a bottom portion 36*a* of the funnel portion 36, and a lower end thereof is appropriately buried in the floor slab 15. However, an end edge portion at the upper end of the connection pipe portion 37 does not project upward from the floor slab 15 over the penetration hole 16.

An outer diameter of the hose guide pipe portion 38 is slightly smaller than an inner diameter of the connection pipe portion 37. An upper end portion 38*b* of the hose guide pipe portion 38 is appropriately inserted into a lower end portion 37*a* of the connection pipe portion 37. Accordingly, a step portion 41 is formed by the upper end portion 38*b* of the hose guide pipe portion 38 inside the connection pipe portion 37. A step portion 42 is also formed by the inner flange portion 40 in the lower end portion 38*a* of the hose guide pipe portion 38.

At least the inner flange portion 40 is made of stainless steel.

In the embodiment illustrated in the drawing, the funnel portion 36 is preferably of cylindrical shape, and a diameter of an opening portion of the penetration hole is preferably about 200 mm. However, other shapes and dimensions may be appropriately employed as occasion demands.

Figure 3:
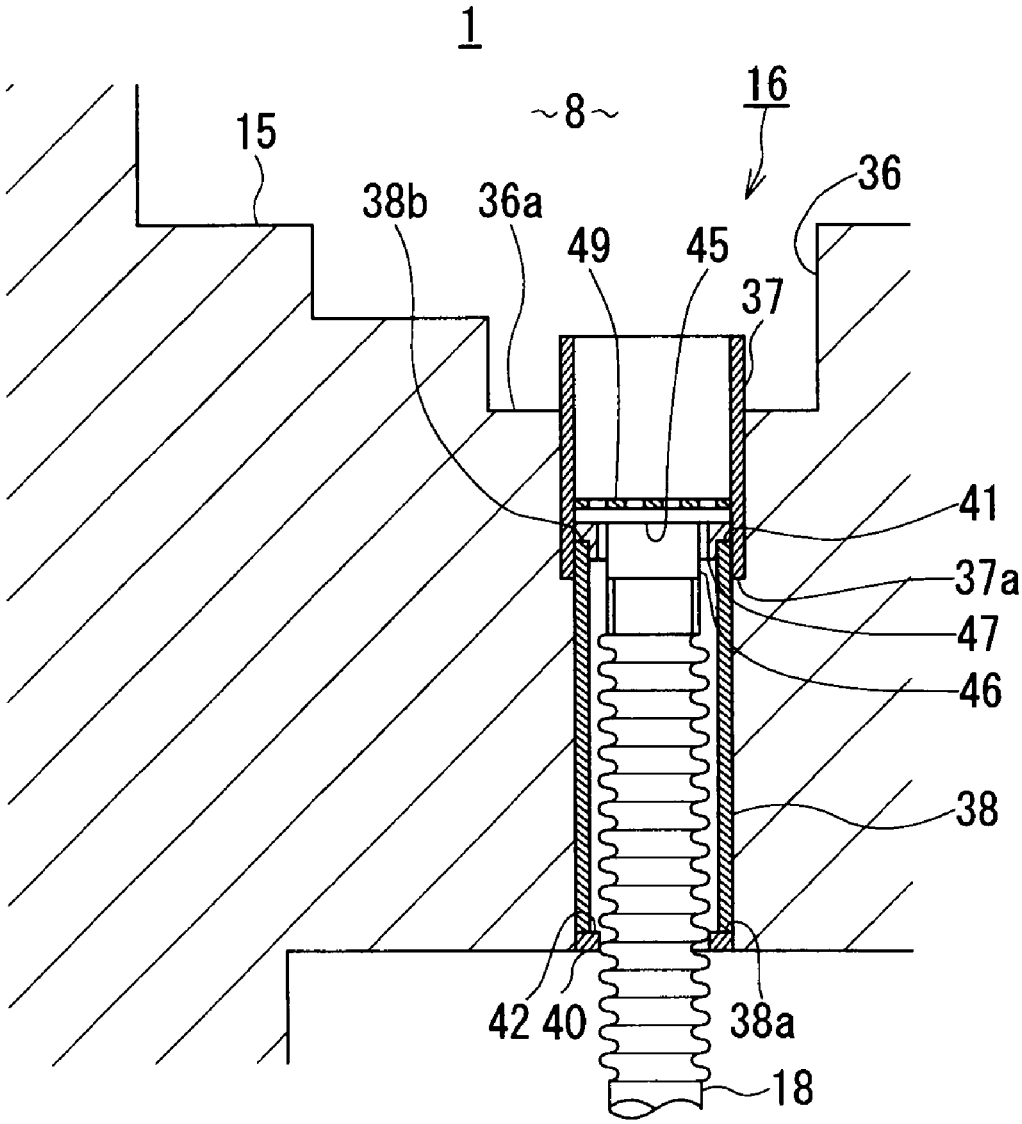
FIG. 3 is a partial sectional view of the multiple-story building illustrating a state in which a collection hose is connected to a floor slab penetration hole of the temporary drainage system according to the present invention.

FIG. 3 is a partial sectional view of the multiple-story building illustrating a state in which the collection hose is connected to the floor slab penetration hole of the temporary drainage system according to the present invention.

As shown in FIG. 3, the collection hose 18 is connected to the floor slab penetration hole 16 formed in the floor slab 15 of the multiple-story building 1 under construction.

A hose connector portion 46 having a flange portion 45 is provided at an end portion (an upper end portion in FIG. 3) of the collection hose 18.

The collection hose 18 is held by bringing the flange portion 45 of the hose connector portion 46 into abutment against the step portion 41 of the floor slab penetration hole 16 via a seal ring 47. When the collection hose 18 is connected to the floor slab penetration hole 16, a grating 49 is provided above the hose connector portion 46.

Figure 4:
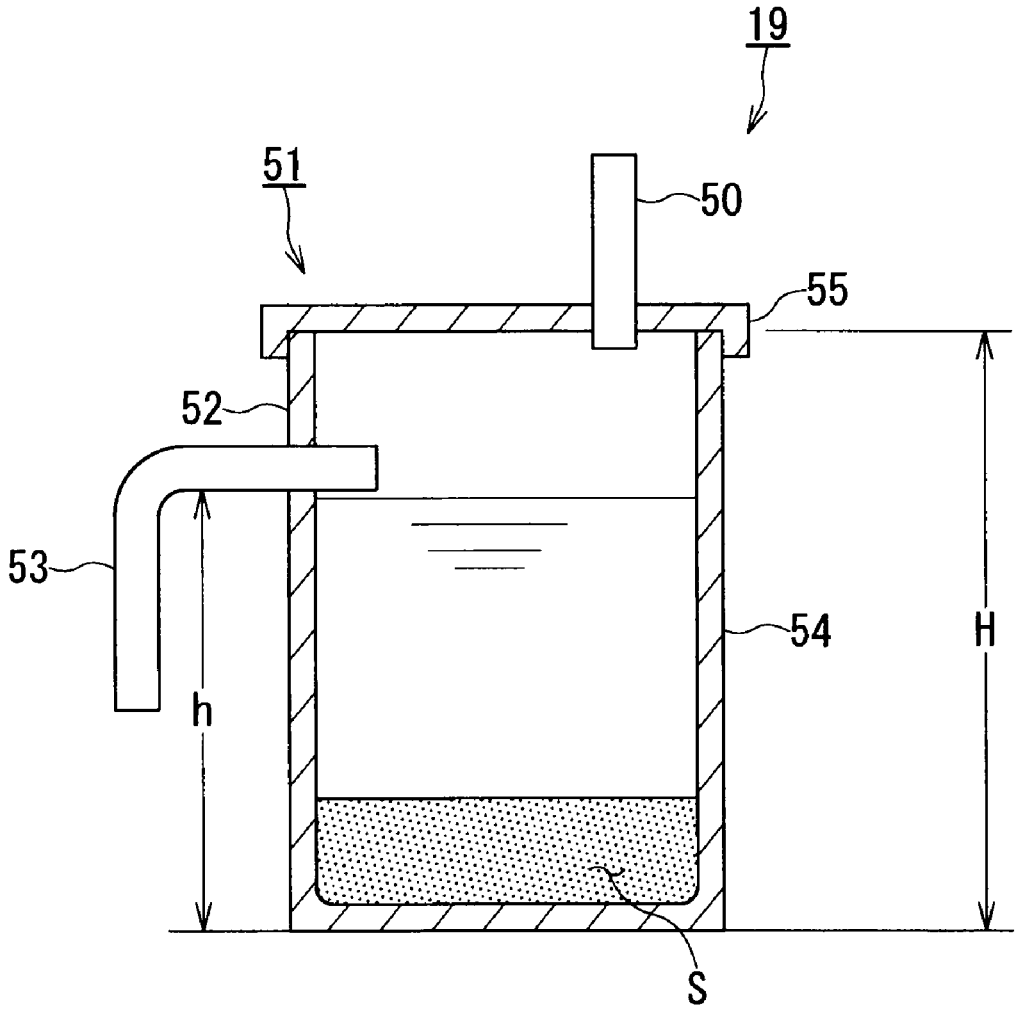
FIG. 4 is a sectional view of a sand-settling vessel of the temporary drainage system according to the present invention.

FIG. 4 is a sectional view of the sand-settling vessel of the temporary drainage system according to the present invention.

As shown in FIG. 4, the sand-settling vessel 19 of the temporary drainage system 11 includes an inflow pipe portion 50 to which the other end portion of the collection hose 18 (a lower end portion in FIG. 3) is connected, a vessel portion 51 where the drainage water flowing through the inflow pipe portion 50 is temporarily stored, and a discharge pipe portion 53 provided in a side wall portion 52 of the vessel portion 51 and connected to the discharge hose 20.

In the temporary drainage system 11 according to the present embodiment, when it rains on the multiple-story building 1, rain water first falls onto the floor slab 15 of the second floor 6 under construction. The rain water falling onto the floor slab 15 of the second floor 6 flows into the floor slab penetration hole 16*a* as the drainage water containing sand and dirt. The drainage water flowing into the floor slab penetration hole 16*a* is temporarily stored in the sand-settling vessel 19*a* through the collection hose 18*a*. The substance such as sand and dirt having a higher specific gravity than water contained in the drainage water settles to the bottom of the sand-settling vessel 19*a* to be stored therein. The drainage water mainly containing liquid from which the substance such as sand and dirt having a higher specific gravity than water is removed is discharged from the sand-settling vessel 19*a*, and flows into the floor slab penetration hole 16*b* or the drainage collection funnel 17 provided in the floor slab 15*a*1 (15*a*2) from the discharge hose 20*a*. The drainage water flowing into the floor slab penetration hole 16*b* is repeatedly conveyed to the lower floors to reach the drainage pit 12. Alternatively, the drainage water flowing into the drainage collection funnel 17 is conveyed to the lower floors through the drainage collection riser pipe 22 and flows into the pit communicating pipe 23 to reach the drainage pit 12.

Next, a post-treatment of the temporary drainage system performed when the drainage of the multiple-story building is not required any more, particularly, a post-treatment of the floor slab penetration hole 16 will be described.

Figure 5:
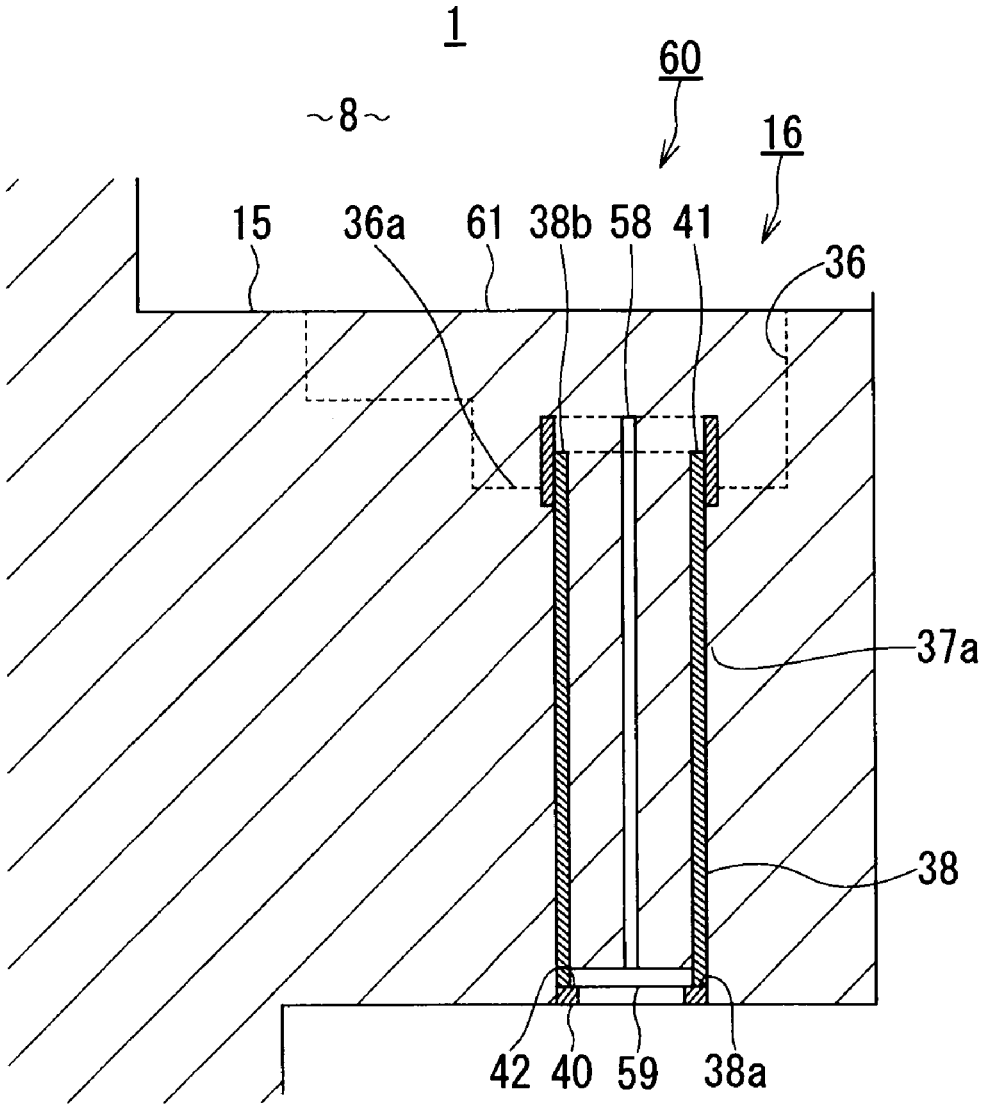
FIG. 5 is a partial sectional view of the multiple-story building illustrating a state in which the floor slab penetration hole of the temporary drainage system according to the present invention is closed.
Figure 6:
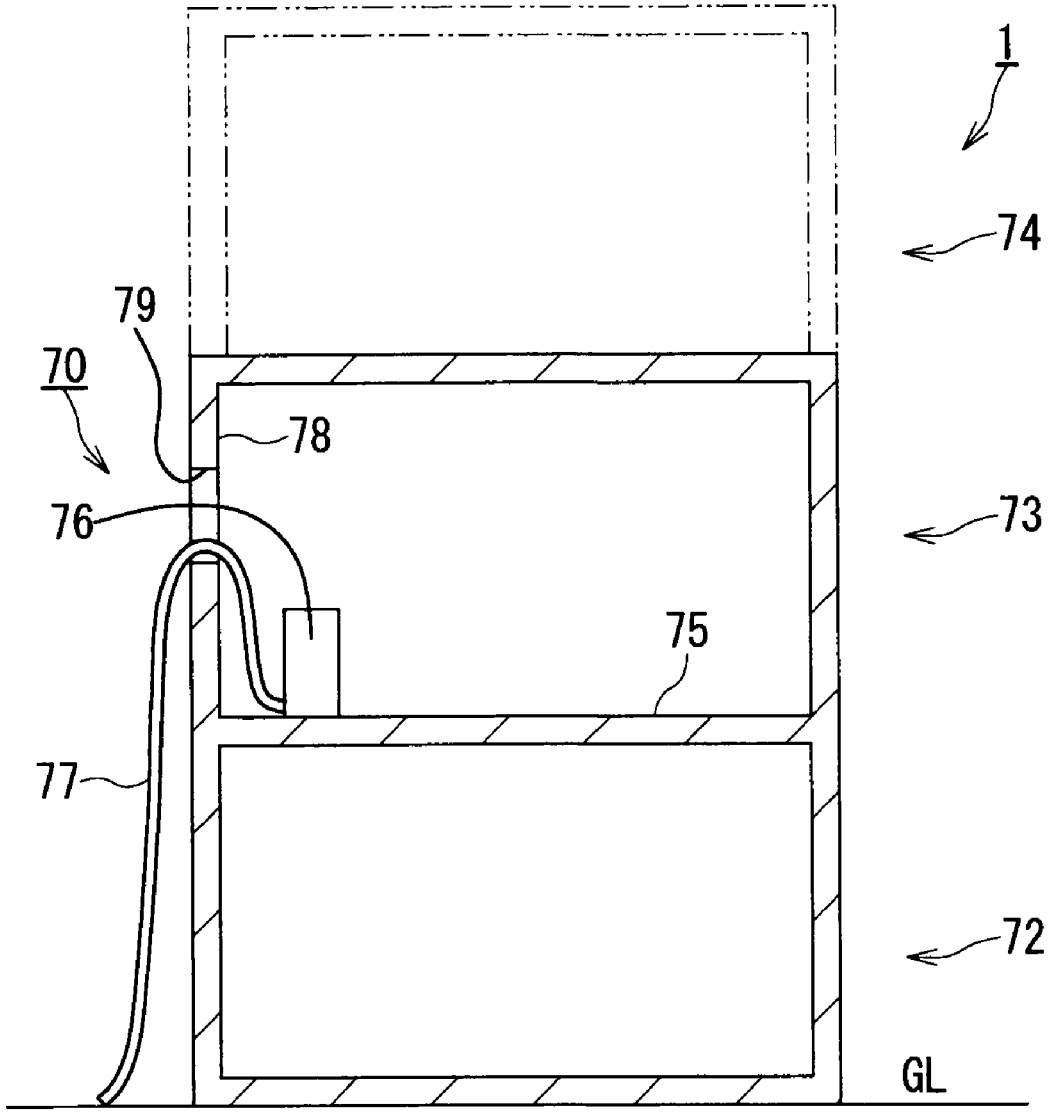
FIG. 6 is a schematic configuration diagram illustrating a conventional drainage system.

FIG. 5 is a partial sectional view of the multiple-story building illustrating a state in which the floor slab penetration hole of the temporary drainage system according to the present invention is closed.

As shown in FIG. 5, the floor slab penetration hole 16 provided in the floor slab 15 of the multiple-story building 1 under construction is closed when there is no risk of inflow of rain water or the like.

When the floor slab penetration hole 16 is closed, the collection hose 18 is removed along with a hose connector portion 46 and a draining grating 49, first. Subsequently, a separately prepared penetration hole closing member 60, which is provided with a disk-shaped closing plate 59 at a distal end of a rod-shaped operation portion 58, is inserted downward through the funnel portion 36, the connection pipe portion 37, and the hose guide pipe portion 38 of the floor slab penetration hole 16, and is engaged with the inner flange portion 40 in a state when the closing plate 59 abuts against the inner flange portion 40.

Accordingly, a diameter of the closing plate 59 is formed smaller than an inner diameter of the hose guide pipe portion 38 and larger than a flange inner diameter of the inner flange portion 40.

Subsequently, mortar 61 as a repairing material is poured into the floor slab penetration hole 16 from the funnel portion 36.

The mortar 61 poured into the floor slab penetration hole 16 is blocked by the closing plate 59 to fill inside of the floor slab penetration hole 16 without leaking to the lower floor. When the mortar 61 is solidified, the floor slab penetration hole 16 is closed.

According to the floor slab penetration hole 16 of the present embodiment, the penetration hole closing member 60 can be easily inserted into the penetration hole from a floor surface being an upper surface of the floor slab 15 to thereby repair and bury the floor slab penetration hole 16. In addition, since the inner flange portion 40 and the closing plate 59 formed of stainless steel are exposed externally to the ceiling surface of a lower floor, i.e., the lower surface of the floor slab 15, it is not necessary to perform a cure such as rust- or corrosion-proof working. Accordingly, for a multiple-story (or multiple-floor) building such as reactor building for which it is not allowed to be caused with the generation of defects such as cracks on floor surfaces, wall surfaces and ceiling surfaces thereof, any defect which may be caused by rust or corrosion to metal portions surrounding the floor slab penetration hole 16 can be prevented from generating.

According to the flow slab penetration hole 16 of the present embodiment, it becomes possible to easily effectively discharge drainage over long period with simple and compact structure in a multiple-story building under construction, and the repairing working thereto can be easily performed.

The invention claimed is:

1. A floor slab penetration structure, comprising:

a penetration hole formed to a floor slab of a building so as to penetrate the floor slab, the penetration hole being provided with a stepped funnel portion, which has substantially a cylindrical shape and opened to a floor slab surface of the building;

a connection pipe communicated with a bottom portion of the funnel portion of the penetration hole, the connection pipe having an upper end disposed below the floor slab surface;

a hose guide pipe inserted into a lower end of the connection pipe so as to be communicated therewith; and an inner flange portion formed to be substantially flush with a lower surface of the floor slab so as to extend inward of the hose guide pipe to abut against and support a lower end of the hose guide pipe so as to extend inward thereof.

2. The floor slab penetration structure according to claim 1, wherein the connection pipe communicated with the bottom portion of the funnel portion of the penetration hole has an inserted upper end positioned below an upper surface of the floor slab of the building.

3. The floor slab penetration structure according to claim 1, wherein the inner flange portion is formed of stainless steel.

4. A method of repairing a penetration hole of a floor slab penetration structure provided with: a penetration hole formed to a floor slab of a building so as to penetrate the floor slab, the penetration hole being provided with a stepped funnel portion, which has substantially a cylindrical shape and opened to a floor slab surface of the building;

a connection pipe communicated with a bottom portion of the funnel portion of the penetration hole, the connection pipe having an upper end disposed below the floor slab surface;

a hose guide pipe inserted into a lower end of the connection pipe so as to be communicated therewith; and an inner flange portion formed to be substantially flush with a lower surface of the floor slab so as to extend inward of the hose guide pipe to abut against and support a lower end of the hose guide pipe so as to extend inward thereof, the repairing method comprising the steps of:

preparing a penetration hole closing member to be inserted into the penetration hole to close the penetration hole;

inserting the penetration hole closing member into the connection pipe disposed in to the penetration hole so as to abut against the inner flange portion to thereby close the penetration hole; and pouring a repairing material into the floor slab penetration hole from the funnel portion thereof.

5. The floor slab penetration hole repairing method according to claim 4, wherein the repairing material is a mortar.

6. The floor slab penetration hole repairing method according to claim 4, wherein the penetration hole closing member is provided with a closing plate made of stainless steel abutting against the inner flange portion so as to close the penetration hole.

* * * * *